US006314857B1

(12) United States Patent
Schmidt et al.

(10) Patent No.: US 6,314,857 B1
(45) Date of Patent: Nov. 13, 2001

(54) WEAPON BARREL

(75) Inventors: Bernd Schmidt, Neuenstein; Berthold Baumann, Eschede, both of (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/498,838

(22) Filed: Feb. 4, 2000

(30) Foreign Application Priority Data

Feb. 4, 1999 (DE) ..... 199 04 417

(51) Int. Cl.[7] ..... F41A 13/12
(52) U.S. Cl. ..... 89/14.1
(58) Field of Search ..... 89/14.1; 42/76.01, 42/76.02

(56) References Cited

U.S. PATENT DOCUMENTS 2,337,840 * 12/1943 Scott-Paine et al. .
4,346,643 * 8/1982 Taylor et al. .
4,638,713 * 1/1987 Milne et al. .
4,762,048 * 8/1988 Higashi et al. .
4,841,836 * 6/1989 Bundy .
4,982,648 * 1/1991 Bol et al. .
5,400,691 * 3/1995 Suttie .
5,837,921 * 11/1998 Rinaldi et al. .

FOREIGN PATENT DOCUMENTS 19 18 422 10/1970 (DE) .
30 46 639 7/1982 (DE) .
32 19 124 4/1984 (DE) .
3827740-A1 * 2/1990 (DE) .
30 05 117 8/1990 (DE) .
2683304-A1 * 5/1993 (FR) .

* cited by examiner

*Primary Examiner*—Charles T. Jordan
*Assistant Examiner*—Troy Chambers
(74) *Attorney, Agent, or Firm*—Venable; Gabor J. Kelemen

(57) ABSTRACT

A weapon barrel includes a liner having first and second circumferential regions; a jacket surrounding the liner; and an arrangement for effecting a heat transfer outwardly from the liner at a greater rate from the first circumferential region than from the second circumferential region.

6 Claims, 1 Drawing Sheet

WEAPON BARREL

CROSS REFERENCE TO RELATED APPLICATION

This application claims the priority of German Application No. 199 04 417.1 filed Feb. 4, 1999, which is incorporated herein by reference.

BACKGROUND OF THE INVENTION

This invention relates to a weapon barrel formed by an inner barrel (hereafter liner) and a protecting outer barrel (hereafter jacket) surrounding the liner.

Weapon barrels of the above-outlined type are known, for example, from German Offenlegungsschriften (applications published without examination) No. 19 18 422 and No. 30 46 639 as well as German Patent No. 30 05 117. The jacket which conventionally coaxially surrounds the liner is intended to protect the liner mostly from outer thermal stresses such as sun, rain or wind to thus prevent a deformation (bending) of the liner because of non-homogenous temperature conditions. A non-uniform heating of the liner and a bending deformation coupled therewith as a result of firing the weapon, however, is not prevented in a satisfactory manner by the conventional jackets.

According to German Patent No. 32 19 124 a non-uniform heating of the liner resulting from firing the weapon is reduced by providing heating elements at the outer wall of the liner. The heating elements are regulated by an evaluating and control device connected to temperature sensors.

The above-outlined conventional weapon barrel is disadvantageous, among others, in that additional components are required for measuring the barrel temperature and for regulating or heating the weapon barrel. Further, energy is needed for actuating the heating elements and the additional components which are arranged at the liner, have to be designed to withstand acceleration forces during recoil especially in case of large-caliber weapon barrels.

SUMMARY OF THE INVENTION

It is an object of the invention to provide an improved weapon barrel of the above-outlined type in which a homogeneous temperature equilibrium is obtained in the liner wall upon firing the weapon.

This object and others to become apparent as the specification progresses, are accomplished by the invention, according to which, briefly stated, the weapon barrel includes a liner having first and second circumferential regions; a jacket surrounding the liner; and an arrangement for effecting a heat transfer outwardly from the liner at a greater rate from the first circumferential region than from the second circumferential region.

According to the basic principle of the invention, an asymmetrical heat transfer is effected from the liner outwardly by influencing the modes of heat transfer, such as heat radiation, convection and heat conduction, so that upon firing a shot the temperature of the liner is equalized.

Since when a shot is fired, the heat-up is usually more intense in the upper region of the liner than in its lower zone, according to the invention suitable measures are provided which ensure that from the upper liner region to the jacket which surrounds the liner a greater heat transfer takes place than from the lower liner region to the jacket. Such a result may be achieved by eccentrically arranging the liner with respect to the jacket and/or by introducing asymmetrical intermediate layers between the liner and the jacket and/or by providing other structural measures for obtaining an asymmetrical heat transfer.

In a preferred embodiment of the invention, the liner and the jacket are arranged in such a manner that between the two components an air-filled annular space remains.

Advantageously, for achieving an asymmetrical heat transfer from the liner, the outer wall of the liner and/or the inner wall of the jacket are coated with materials having unlike emission coefficients.

DESCRIPTION OF THE PREFERRED EMBODIMENT

Figure 1:
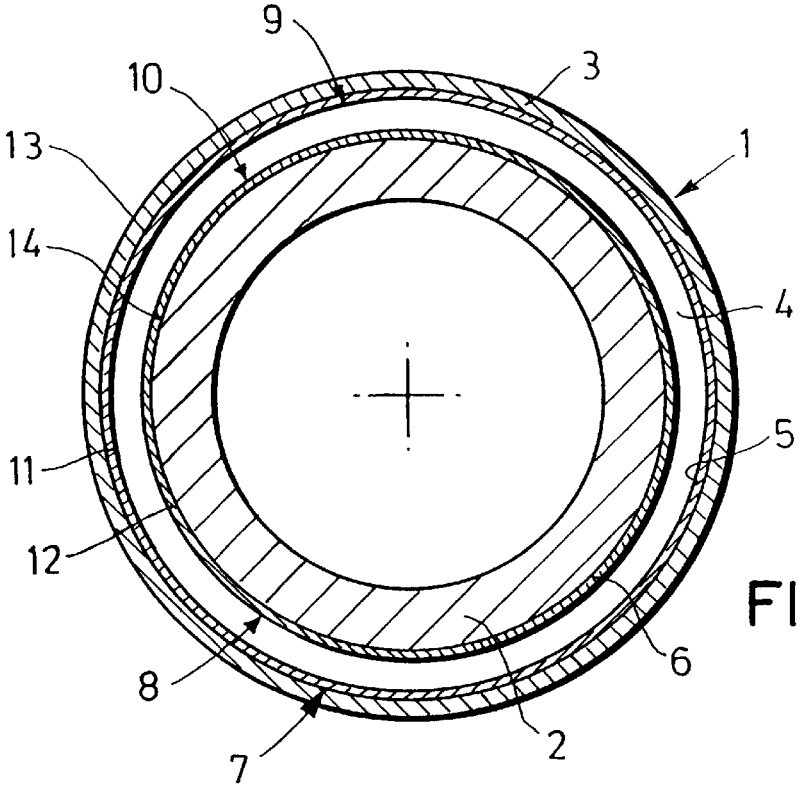
FIG. 1 is sectional end view of a weapon barrel according to a first preferred embodiment of the invention.

FIG. 1 shows a weapon barrel 1 having a liner 2 and an aluminum alloy jacket 3 which surrounds the liner 2. The liner 2 and the protective jacket 3 are coaxially arranged with respect to one another and define together an air-filled annular chamber 4.

The inner wall face 5 of the jacket 3 and the outer wall face 6 of the liner 2 are coated with unlike materials 11–14 in their lower region 7, 8 on the one hand and in their upper region 9, 10 on the other hand. As seen, these two regions of the liner 2 represent two circumferentially offset parts of the liner 2. Taking into consideration the more significant heat-up in the upper region 10 of the liner 2 and also in the upper region 9 of the jacket 3 upon firing, a material layer with a higher coefficient of emission is provided in the upper regions 9 and 10 than in the respective lower regions 7 and 8 of the liner 2 and the jacket 3.

By virtue of this measure, upon firing the weapon 1, across the upper region 10 of the liner 2 more heat is transferred outwardly than across the lower region 8, so that temperature differences which would occur without such layers are compensated for.

Figure 2:
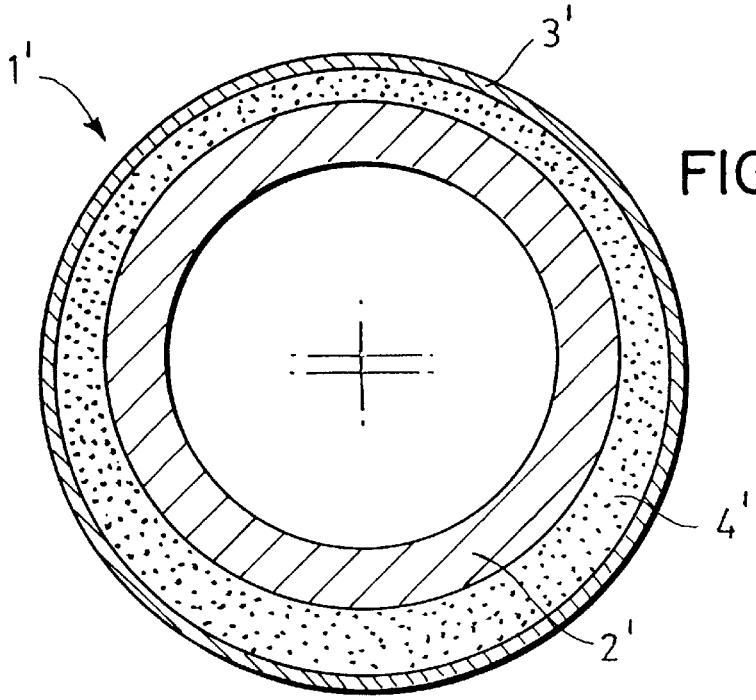
FIG. 2 is sectional end view of a weapon barrel according to a second preferred embodiment of the invention.

In the embodiment illustrated in FIG. 2 a weapon barrel 1' is shown where the liner 2' and the jacket 3' are eccentrically arranged with respect to one another so that heat transfer from the liner 2' outwardly is influenced by the heat conducting asymmetrical annular chamber 4' defined between the liner 2' and the jacket 3'.

It will be understood that the above description of the present invention is susceptible to various modifications, changes and adaptations, and the same are intended to be comprehended within the meaning and range of equivalents of the appended claims.

What is claimed is:

1. A weapon barrel comprising (a) a liner having first and second circumferentially offset regions;

(b) a jacket surrounding said liner; and (c) means for transferring heat to a greater extent from said first region of said liner to said jacket than from said second region of said liner to said jacket.

2. The weapon barrel as defined in claim 1, further comprising an annular chamber defined between said jacket and said liner and further wherein said means comprises an eccentric arrangement of said liner with respect to said jacket for transferring heat to a greater extent from said first region of said liner to said jacket than from said second region of said liner to said jacket.

3. The weapon barrel as defined in claim 1, wherein said liner has an outer surface coated with materials having a heat emitting coefficient in said first region of said liner that is different from a heat emitting coefficient in said second region of said liner.

4. The weapon barrel as defined in claim 1, wherein said jacket has an inner surface coated with materials having a heat emitting coefficient radially facing said first region of said liner that is different from a heat emitting coefficient radially facing said second region of said liner.

5. The weapon barrel as defined in claim 1, wherein said jacket is an aluminum alloy.

6. The weapon barrel as defined in claim 1, further comprising an annular chamber defined between said jacket and said liner and further wherein said means comprises a smaller distance from said first region of said liner to said jacket across said annular chamber than from said second region of said liner to said jacket across said annular chamber for transferring heat to a greater extent from said first region of said liner to said jacket than from said second region of said liner to said jacket.

* * * * *